United States Patent [19]

Cossey

[11] 4,159,717

[45] Jul. 3, 1979

[54] ANTISET PROTECTOR FOR SECOND STAGE SCUBA REGULATORS

[75] Inventor: Mike R. Cossey, Huntington Beach, Calif.

[73] Assignee: Under Sea Industries, Inc., Compton, Calif.

[21] Appl. No.: 804,231

[22] Filed: Jun. 7, 1977

[51] Int. Cl.[2] ..... B63C 11/16; A62B 9/02

[52] U.S. Cl. ..... 128/142.2; 137/DIG. 9; 137/316

[58] Field of Search ..... 128/142.2, 147, 203, 128/142 R; 137/495, 316, DIG. 9

[56] References Cited

U.S. PATENT DOCUMENTS

| | | | |
|---|---|---|---|
| 1,147,840 | 7/1915 | Bowser | 137/316 |
| 2,135,243 | 11/1938 | Swain | 137/495 X |
| 2,406,888 | 9/1946 | Meidenbauer, Jr. | 128/142.2 |
| 2,854,001 | 9/1958 | Humblet | 128/142.2 |
| 3,799,189 | 3/1974 | Christianson | 137/316 |

*Primary Examiner*—Henry J. Recla
*Attorney, Agent, or Firm*—Flam & Flam

[57] ABSTRACT

When the regulator is stored, a removable spacer is interposed between the pressure sensing diaphragm and the regulator case in order to position the resilient closure of the demand valve away from its seat. The resilience of the unconfined closure causes it to assume its normal free configuration. A compression set, which would impair sealing capability, is avoided.

5 Claims, 6 Drawing Figures

ANTISET PROTECTOR FOR SECOND STAGE SCUBA REGULATORS

FIELD OF INVENTION

This invention relates to scuba diving equipment, and particularly to valve mechanisms for diaphragm operated demand regulators. Specifically, this invention relates to the resilient characteristics of the sealing element of the demand valve mechanism.

BACKGROUND OF THE INVENTION

A second stage regulator of scuba diving apparatus includes a demand valve for supplying breathable gases to the diver, a diaphragm for sensing the inhalations of the diver, or his demand for breathable gases, and a linkage between the diaphragm and the demand valve for opening the valve in response to demand. The demand valve includes some resilient sealing element, such as an O-ring, a disc, a frusto-conical plug or the like. The resilient sealing element is urged to close by a spring, the power of which must be overcome by the inhalation force acting on the diaphragm. When the apparatus is stored, the sealing element is constantly pressed against the seat. Consequently, there is a substantial possibility that the sealing element will take on a compression set, that is, a loss of resilience and a consequent diminished ability to seal. Incomplete closure results in the loss of precious breathable gases. Frequent replacement of the sealing element is required.

The primary object of the present invention is to provide a simple means for prolonging the useful life of a sealing element of a demand regulator.

SUMMARY OF INVENTION

In order to accomplish the foregoing object, I provide a removable spacer designed to be used when the regulator is stored. The spacer is inserted into the regulator case in order to block the diaphragm from full return movement. The linkage between the diaphragm and the demand valve moves the resilient sealing element away from its seat so that a compression set is avoided. When the regulator is prepared for use, the spacer is simply removed. For purposes of convenience, the spacer may be tethered to the high pressure hose between the first and second regulator stages.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

Figure 1:
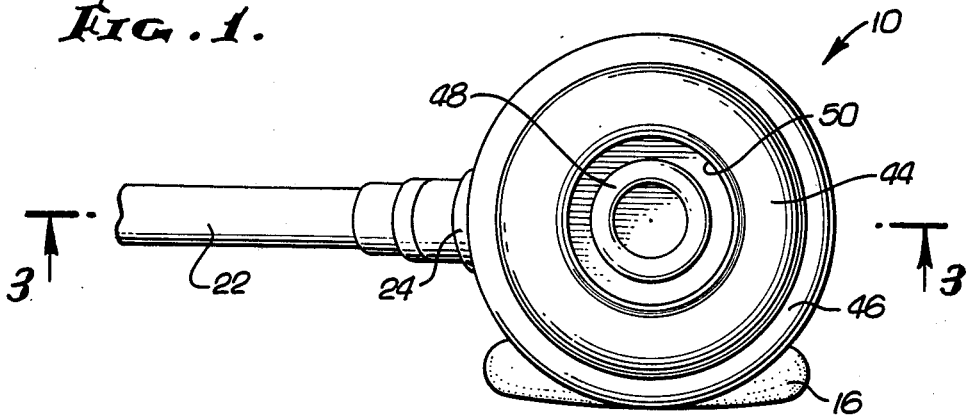
FIG. 1 is a front elevational view of a typical diaphragm operated second stage scuba regulator.
Figure 2:
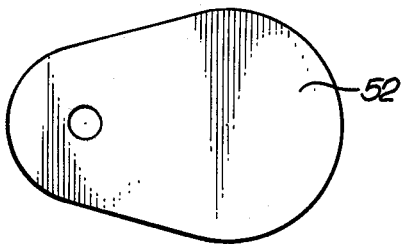
FIG. 2 is a plan view of a spacer adapted to be inserted beneath the cover ring of the regulator.
Figure 3:
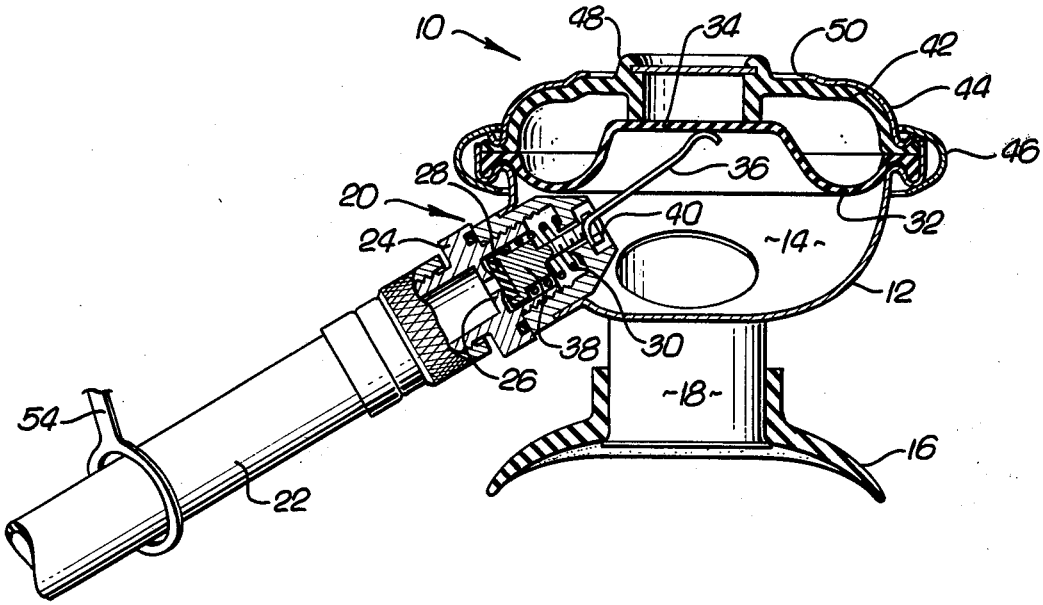
FIG. 3 is a sectional view of the regulator taken along a plane corresponding to line 3—3 of FIG. 1.

The following detailed description is of the best presently contemplated mode of carrying out the invention. This description is not to be taken in a limiting sense, but is made merely for purposes of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made. A second stage scuba regulator 10 shown in FIG. 1 includes a cup-shaped case 12 (FIG. 2) providing an inhalation chamber 14. The chamber 14 directly connects to a mouthpiece 16 via a short circuit 18 on which the mouthpiece is mounted. Breathable gases are conducted to the chamber 14 by the aid of a valve assembly 20 that is mounted by the case. A hose 22 from a high pressure source, such as the first stage scuba regulator (not shown) attaches to a fitting 24 of the valve assembly.

The details of the valve assembly are unimportant except that the valve assembly includes a valve seat 26, a resilient closure member 28 and a spring 30 that normally urges the resilient closure into engagement with the seat. In use, the valve admits air into the chamber in response to inhalation by the diver. In a conventional manner, inhalation is sensed by a diaphragm 32 that closes the chamber 14. The central portion of the diaphragm 32 includes a relatively rigid disc 34 that cooperates with a lever 36 pivoted on the valve 20. As the diaphragm moves inwardly in response to inhalation, the lever 36 lifts the valve closure member 28 away from its seat 26 in order to establish a flow path to the chamber 14. For this purpose, the closure member 28 is mounted on a valve stem 38 that has a head 40 cranked by the inner end of the lever 36. The spring 30 surrounds the stem 38 and urges the valve to close just as soon as the diver's demand for air is satisfied.

Overlying the diaphragm 32 is a flexible cover 42. The flexible cover as well as a relatively rigid cover ring 44 are clamped to the edge of the case 12 along with the diaphragm 32 by the aid of a clamping band 46. The flexible cover 42 has a central button 48 accessible through the central opening 50 of the cover ring. Accordingly, the diver may, by digitally engaging the button 34, move the diaphragm inwardly thereby to override the sensing chamber and open the valve in order to send a rush of air to the mouthpiece.

Figure 4:
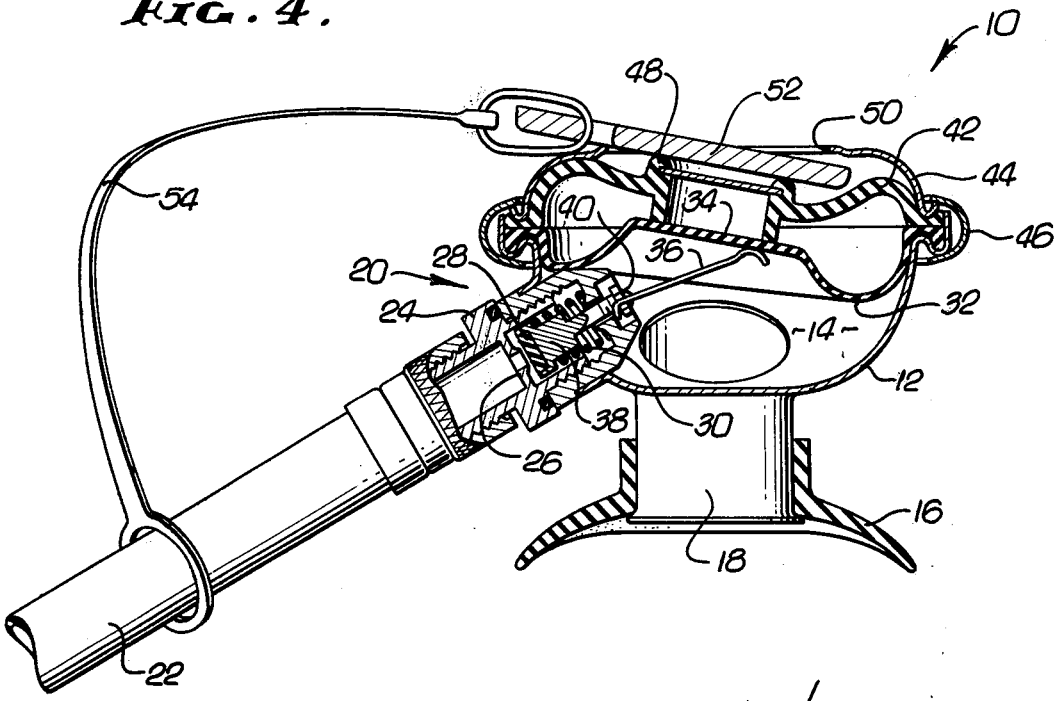
FIG. 4 is a view similar to FIG. 3, but showing the spacer inserted.

When the regulator is stored, the closure 28 is normally spring urged against the seat 26 until the regulator is used. The closure 28 tends to take on a compression set with consequent loss of sealing ability. In order to guard against a compression set and in order to improve the life of the closure 28, a spacer 52 is provided. The spacer 52 as shown in FIG. 4 has a semicircular end designed to fit into the cover ring opening 50 to be interposed between the cover ring 44 and the flexible cover 42 such that the button holds the diaphragm depressed and the closure member 28 away from the seat. The spacer 52 is removed only when the regulator is ready for use and reinserted just as soon as the regulator is to be stored. Conveniently, the spacer 52 may be tethered to the hose 22 by a flexible line 54.

DESCRIPTION OF ALTERNATE EMBODIMENT

Figure 5:
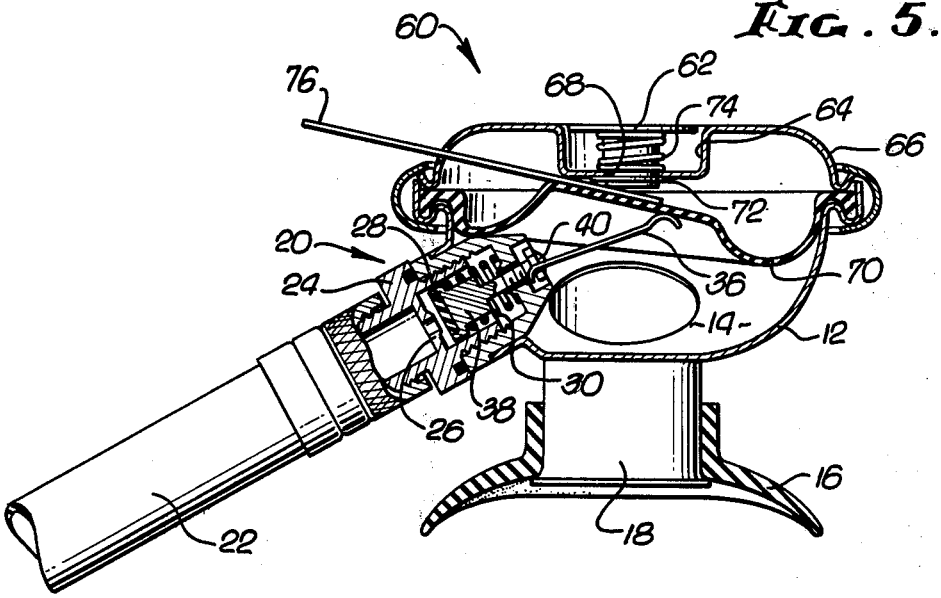
FIG. 5 is a sectional view similar to FIG. 4, but illustrating another diaphragm operated second stage regulator with a spacer inserted.
Figure 6:
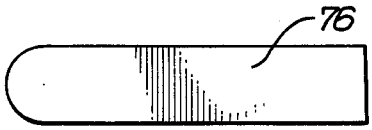
FIG. 6 is a plan view of the spacer shown in FIG. 5.

Spacers may be designed to fit virtually all second stage regulators. A second type of regulator 60 is shown in FIG. 5. In this instance, an override button 62 is mounted in a central recess 64 of a cover ring 66. The override button projects through an opening 68 for engagement with the central portion of the diaphragm 70. A C-ring 72 engages the edges about the opening 68 to limit outward movement of the button under the influence of a retracting spring 74. In the present instance, the valve and lever assembly are the same as in the previous form. A spacer 76 is insertable through a slot in the cover ring 66 to be interposed between the inner end of the override button and the diaphragm in order to space the sealing member from its seat. The resilience of the diaphragm clamps the spacer in place. In the present embodiment as in the prior embodiment, the sealing member is held away from its seat during extended storage in order to maintain the sealing qualities of the sealing member over a long period of time.

The spacer can be interposed at any convenient place between the case and the diaphragm. The spacer could be inserted through a slot to hold the button depressed. The button itself could serve as the spacer by providing a releasable lock between the button and the case.

Intending to claim all novel, useful and unobvious features shown or described, I make the following claims:

1. In a demand regulator of a scuba apparatus:

(a) a regulator case;

(b) a pressure sensing element mounted in the case for movement in a path;

(c) means forming in the case, an inhalation chamber exposed to one side of the sensing element;

(d) means forming in the case, an ambient chamber exposed to the other side of the sensing element, there being at least one access opening through the case to said ambient chamber;

(e) a demand valve attached to the case and having a valve closure, and a seat relatively movable to admit breathable gas into said inhalation chamber, and a resilient sealing element between the closure and the seat;

(f) spring means urging said closure and seat to clamp the sealing element between the seat and the closure;

(g) linkage means between the sensing element and said demand valve to move said valve closure and seat away from each other entirely to free the sealing element from clamping engagement in response to a reduction in pressure in said inhalation chamber; the combination therewith of:

(h) spacer means selectively interposed between said sensing element and said case and retractable from within said case and operative to move and hold said closure and seat entirely away from each other whereby, during storage or nonuse of said demand regulator, said resilient sensing element is entirely uncompressed and thereby protected from compression set.

2. The combination as set forth in claim 1 in which said spacer is retractably positioned through one of said access openings to be interposed between said sensing element and said case.

3. The combination as set forth in claim 1 in which said access opening is substantially circular, said spacer having a substantially semicircular end smaller than said opening to fit beneath the edges of said access opening.

4. The combination as set forth in claim 1 together with a high pressure hose attached to said demand valve for conducting breathable gas to said inhalation chamber, and a flexible tether between said spacer and said hose.

5. The combination as set forth in claim 1 in which said demand regulator includes a normally retracted override button mounted on said case and movable by digital pressure to engage said sensing element, said spacer being inserted between said button and said element.

* * * * *

UNITED STATES PATENT OFFICE

CERTIFICATE OF CORRECTION

Patent No. 4,159,717 Dated July 3, 1979

Inventor(s) MIKE R. COSSEY

It is certified that error appears in the above-identified patent and that said Letters Patent are hereby corrected as shown below:

Column 4, line 20: cancel "sensing" and substitute --sealing--

Signed and Sealed this

*Eleventh* Day of *March 1980*

[SEAL]

*Attest:*

SIDNEY A. DIAMOND

*Attesting Officer*

*Commissioner of Patents and Trademarks*